United States Patent [19]

Groves

[11] Patent Number: 4,993,770

[45] Date of Patent: Feb. 19, 1991

[54] CARRYING DEVICE FOR ATHLETIC WEIGHTS

[75] Inventor: Philip J. Groves, Woodland Hills, Calif.

[73] Assignee: Weider Health & Fitness, Woodland Hills, Calif.

[21] Appl. No.: 544,050

[22] Filed: Jun. 22, 1990

Related U.S. Application Data

[63] Continuation of Ser. No. 300,967, Jan. 23, 1989, abandoned.

[51] Int. Cl.[5] ..... B65D 85/02

[52] U.S. Cl. ..... 294/158; 294/159; 206/303; 211/41

[58] Field of Search ..... 294/158–162, 294/145, 137; 224/270, 906; 206/303, 310, 311; 211/40, 41

[56] References Cited

U.S. PATENT DOCUMENTS

| | | | |
|---|---|---|---|
| D. 114,637 | 5/1939 | Heil et al. | 211/40 X |
| 2,278,214 | 3/1942 | Pearson | 294/158 X |
| 3,053,424 | 9/1962 | Reinhard | 294/158 X |
| 3,167,211 | 1/1965 | McCormick | 294/159 X |

*Primary Examiner*—Russell D. Stormer
*Assistant Examiner*—Dean J. Kramer
*Attorney, Agent, or Firm*—Blakely, Sokoloff Taylor & Zafman

[57] ABSTRACT

The carrying device comprises a folded material, such as cardboard, which surrounds a pair of weights in a frame. The frame comprises an upwardly extending center panel and two side panels. The side panels are disposed parallel to the center panel and are separated from the center panel by a distance which is slightly larger than the thickness of the weights. The side panels are connected to the center panel by bottom panels. A wooden rod is placed through the center holes of the athletic weights, and anchored into the side of the cardboard frame. A handle located in the frame allows the weights to be easily carried.

1 Claim, 4 Drawing Sheets

CARRYING DEVICE FOR ATHLETIC WEIGHTS

This is a continuation of application Ser. No. 07/300,967 filed 1/23/89 now abandoned.

FIELD OF THE INVENTION

This invention relates to the field of article carriers and, more specifically, to a carrying device for athletic weights.

BACKGROUND OF THE INVENTION

Athletic weights typically have the shape of a flat disc with a hole disposed in the center. They somewhat resemble a flattened doughnut in appearance. These weights are manufactured from a suitable material such as steel or concrete filled plastic. Because of their very nature, these athletic weights may be heavy, weighing in the range of one (1) pound to over fifty (50) pounds. Depending on the amount of weight which is desired, athletic weights come in a range of diameters and thicknesses.

Because of the weights' unusual shape, it has been difficult for a user, in the past, to easily transport the weights from location to location. Also, when the weights are sold, such as in a sporting goods store, there has not been an effective way to display the athletic weights in an attractive or safe manner. Previously, the weights were simply stacked in large piles or packaged within boxes. When the weights were stacked up, it was difficult for the user to transport them home after making a purchase. Conversely, when the weights were placed within boxes, the prospective purchaser would be unable to view the actual product which he would be buying.

SUMMARY OF THE INVENTION

The present invention overcomes these limitations in the prior art by providing a carrying device for athletic weights. The carrying device gives a user a means for easily transporting the weights from location to location. Also, the carrying device provides an attractive package in which the weights can be marketed. After a customer purchases the weights, they may easily transport them to the desired location in the carrying device.

The carrying device comprises a folded material, such as cardboard, which surrounds a pair of weights in a frame. The frame comprises an upwardly extending center panel and two side panels. The side panels are disposed parallel to the center panel and are separated from the center panel by distance which is slightly larger than the thickness of the weights. The side panels are connected to the center panel by bottom panels. A wooden dowel is placed through the center holes of the athletic weights, and anchored into the side of the cardboard frame. A handle located in the frame allows the weights to be easily carried.

DETAILED DESCRIPTION OF THE INVENTION

A carrying device for athletic weights is disclosed. In the following description, numerous details such as specific shapes and construction materials are set forth in order to provide a more complete description of the present invention. It will be apparent to those skilled in the art, however, that the present invention may be practiced without these specific details. In other instances, details which are well known in the art, such as manufacturing techniques, are not described in detail so as not to obscure the present invention unnecessarily. Moreover, the following specification makes reference to athletic weights which are used in conjunction with the present invention. These weights are included in the description simply to provide a more thorough understanding of the present invention and its operation. While the invention is used in conjunction with the weights, it is to be understood that the weights themselves are not an element of an invention. Instead, the invention consists solely of the carrying device itself.

Figure 1:
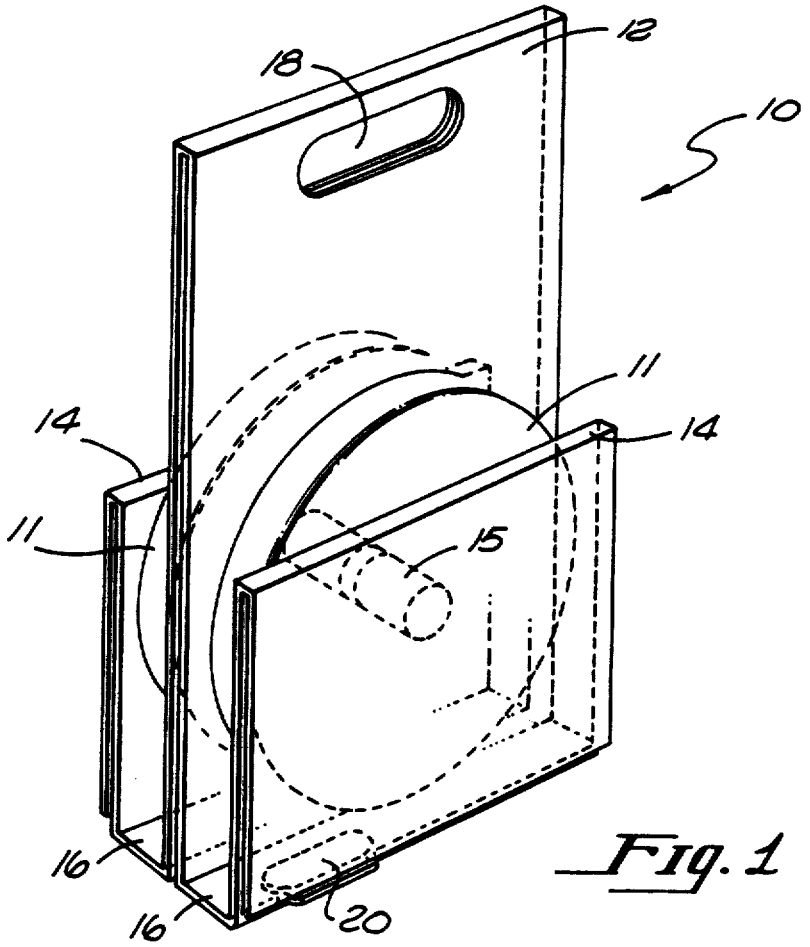
FIG. 1 is a perspective view of the preferred embodiment of the present invention shown in combination with two athletic weights.

Referring first to FIG. 1, a perspective view of the preferred embodiment of the present invention is shown. The carrying device is shown containing two athletic weights 11. The carrying device is comprised of a main frame 10 which retains the weights in an upright, side-by-side, manner. A support rod 15 is placed through the center holes of the weights 11 and anchored in holes 19 in the frame 10 to support the weights. Handle 18 is located in the center panel to allow the frame to be carried.

Figure 3:
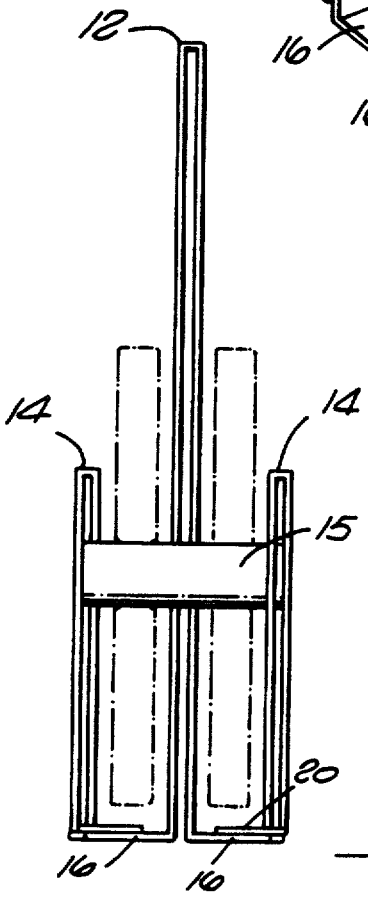
FIG. 3 is sectional view of the preferred embodiment of the present invention taken along the line 3—3.
Figure 2:
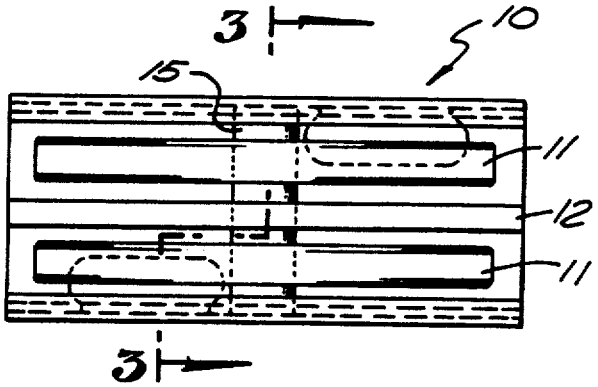
FIG. 2 is a top view of the preferred embodiment of the present invention shown in combination with two athletic weights.

As can be seen best in FIG. 3, the frame 10 has a upwardly extending center panel 12 which, in the preferred embodiment, rises higher than the weights 11. Two upwardly extending side panels 14 are disposed substantially parallel to the center panel 12, and are set apart at a predetermined distance from the center panel 12. This distance is typically slightly larger than the thickness of the weights. By minimizing this distance, the carrying device can be made as small as possible. The side panels 14 are connected to the center panel 12 by bottom panels 16. The side, bottom, and center panels are joined together so as to form two U-shaped cavities. The weights are placed within these cavities. All of the panels have a width which is approximately equal to the outer diameter of the weights. This allows the frame to remain compact while still completely surrounding the weights. Although the present invention is shown with two side panels and two cavities, it will be appreciated by those skilled in the art that only single side panel may also be used.

The height of the side panels 14 is not critical. Typically, they will be shorter than the center panel 12. They should, however, be of sufficient height so that the support rod can be easily placed through the center holes of the athletic weights. Thus, in the preferred embodiment, the side panels 14 have a height which is slightly higher than half the diameter of the weights.

In the preferred embodiment, the frame 10 is manufactured from a lightweight, foldable material such as cardboard. A lightweight material is chosen since the weights, by their very nature, are heavy. In the preferred embodiment, the center panel 12, side panels 14, and bottom panel 16 are all formed from the same piece of material. The material is folded into its final shape, thus creating the frame 10. If this manufacturing technique is adopted, then the center panel 12 and side panels 14 will each be made up of a double thickness of material. This is best seen in FIG. 3, which is a cross-sectional view of the frame. This double thickness is advantageous in that it provides additional support points for the support rod 15. As can be seen in FIG. 3, when the panels are made from a double thickness of material, there are a total of six support points for the support rod 15. It will be apparent to those skilled in the art, however, that other manufacturing techniques can easily be employed to make the frame. For example, all of the panels may be made from separate pieces of cardboard and joined together by gluing or some other equivalent means.

The support rod 15 is manufactured from a rigid material such as wood. The diameter of the rod is chosen so as to be slightly smaller than the center holes of the weights 11. The weights will, therefore, fit snugly over the support rod 15. Smaller diameter support rods may be used if desired. This option may be chosen if, for example, a variety of different sized weights are to be carried, each with a different diameter center hole. The only limitation on the diameter of the rod is that it must be able to pass through the center holes of the weights. The frame 10 is relatively narrow, since the weights are generally thin. Thus, the length of the support rod 15 will not be very large as compared to its diameter. This low length-to-diameter ratio increases the stiffness of the support rod 15, allowing heavier weights to be carried. It will be apparent to those skilled in the art that equivalent materials such as plastic or metal may also be used for the support rod 15.

Figure 4:
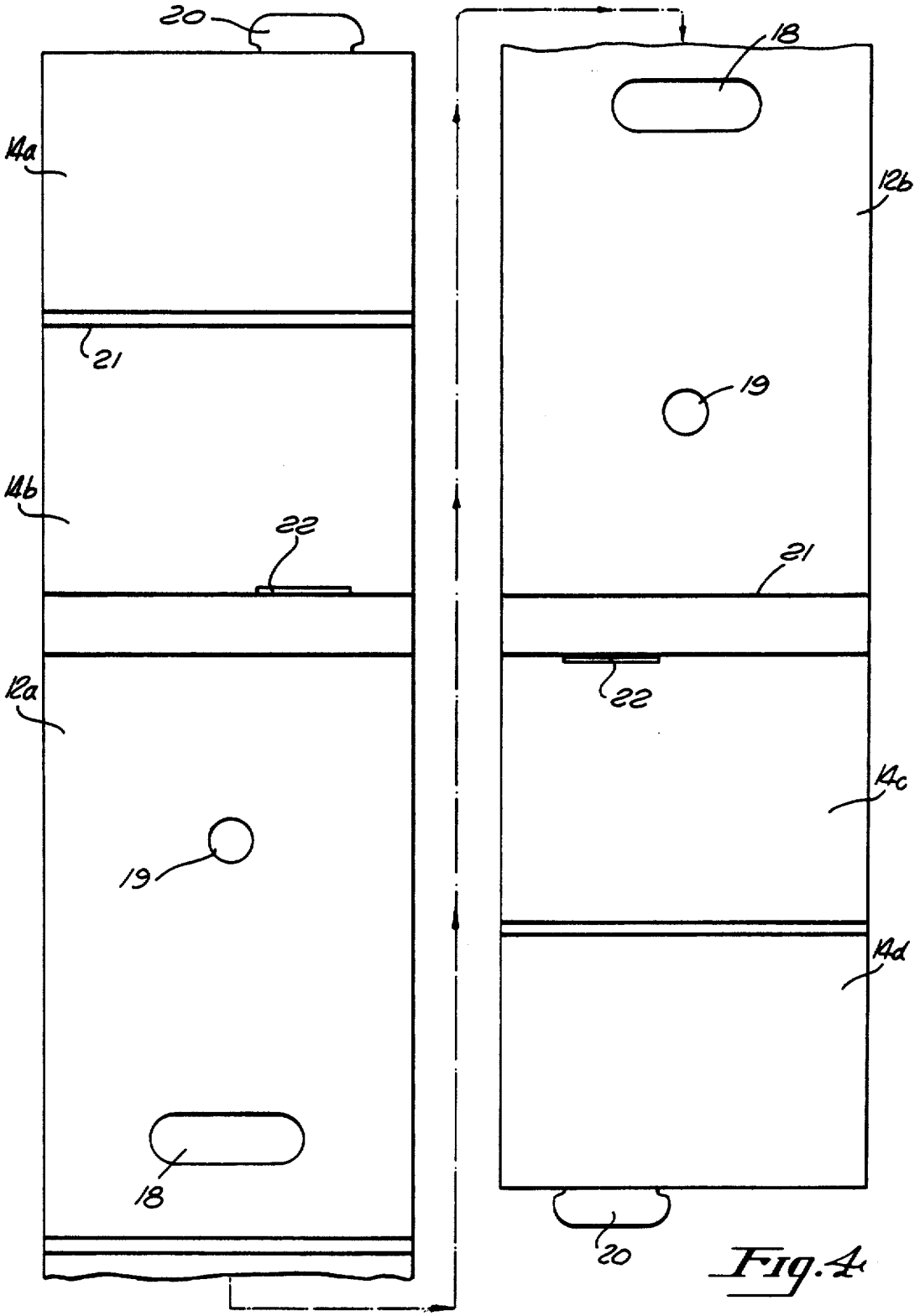
FIG. 4 shows the frame in an unfolded position.

Referring next to FIG. 4, a plan view of the preferred embodiment of the frame is shown in its unfolded configuration. As can be seen, the frame is made up from a single piece of material which is divided into several different panels. Sections 12*a* and 2*b* make up the center panel 12. Similarly, sections 14*a* and 14*b* make up one side panel 14, and sections 14*c* and 14*d* make up the second side panel 14. In order to facilitate the folding of the frame, the cardboard material is scored with lines which are generally referred to by reference numeral 21 in FIG. 4. Manufacturing the frame from a single piece of material facilitates the construction of the carrying device. The handles 18 are cutouts which are placed in the desired location. Similarly, holes 19 are cut out for the support rod 15. Tabs 20 are provided which fit within slot 22 when the frame is folded. The tabs and slots work together to keep the frame folded when it is in use.

Figure 5:
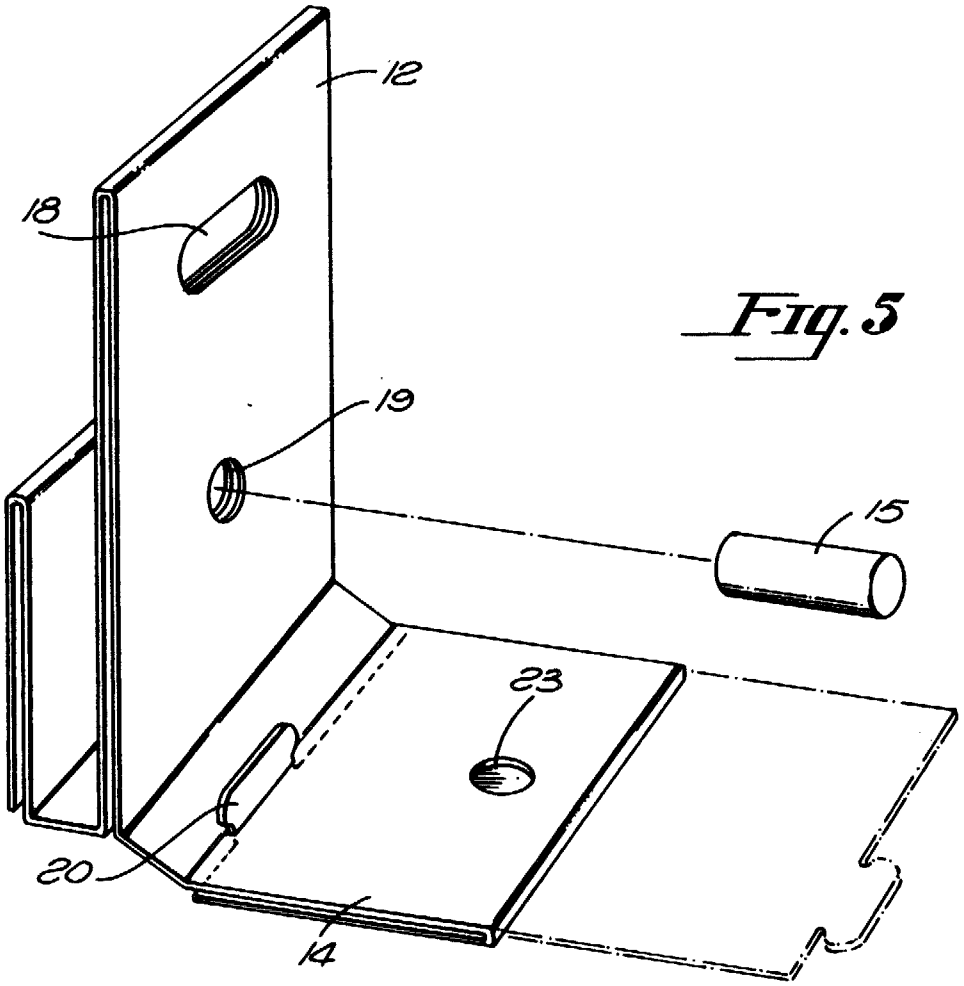
FIG. 5 shows the frame in a partially folded configuration and the location of the support dowel.

Referring next to FIG. 5, a view of the frame 10 is shown partially unfolded. This view shows how the tab 20 is placed through slot 22 to hold the frame together. FIG. 5 also illustrates how the support rod 15 is placed through the hole 19 in the center panel 12. After the rod 15 is placed through hole 19, the athletic weights (not shown) are placed over the rod and side panel 14 is folded upwards. Opening 23 then fits over the end of support rod 15, thereby supporting the weights.

Figure 6:
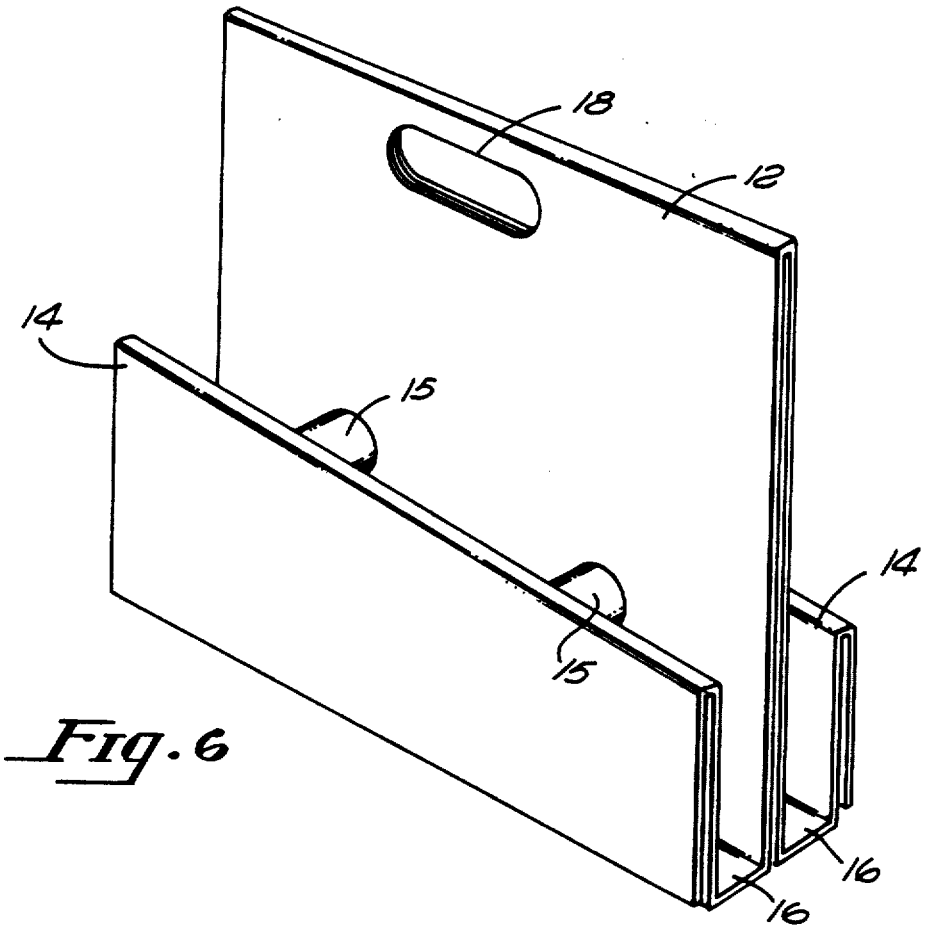
FIG. 6 is a perspective view of an alternative embodiment of the present invention.
Figure 7:
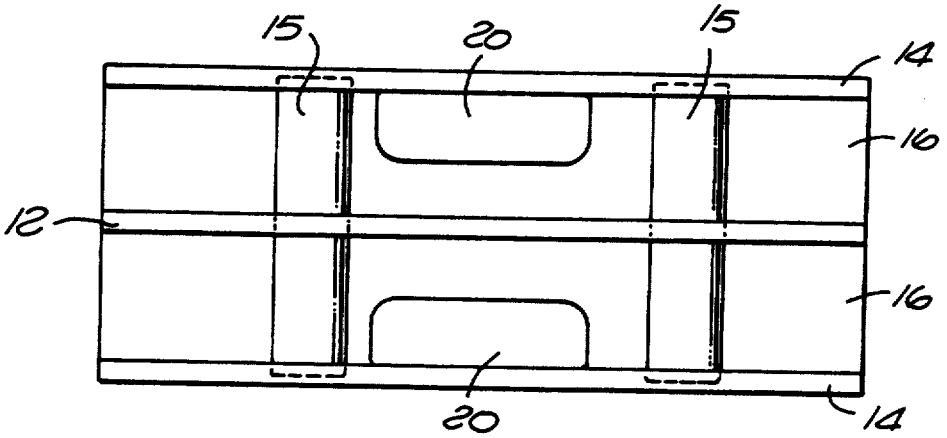
FIG. 7 is a top view of the alternative embodiment of the present invention.

FIGS. 6 and 7 show an alternative embodiment of the present invention. In the alternative embodiment illustrated, the support device has two support rods for the weights. Also, the width of the center, bottom and side panels is increased to be approximately twice the outer diameter of the weights. It can be seen that this embodiment will allow four separate weights to be carried. This embodiment is particularly suited for instances when it is desired to carry several weights, each of which is relatively light.

Accordingly, a carrying device for athletic weights has been disclosed. In the foregoing Specification, the present invention has been described with reference to specific exemplary embodiments thereof. It will be appreciated by those skilled in the art that variations may be made from these specific example without departing from the broader spirit and scope of the present invention. The foregoing Specification is to be regarded, therefore, as illustrative rather than restrictive. The full scope of the present invention is limited only by the following claims.

What is claimed is:

1. A device for carrying athletic weights, said weights having a center hole disposed therethrough, comprising:

an upwardly extending center panel;

a handle disposed within said center panel;

first and second side panels disposed on opposite sides of said center panel and being substantially parallel thereto, said side panels being held a predetermined distance away from said center panel by first and second bottom panels, wherein said first and second side panels, said first and second bottom panels, and said center panel are manufactured from a single piece of material, said material being folded such that said center panel, and each of said side and bottom panels form a U-shaped cavity for receiving said weights;

a support rod disposed through holes located in said center and said side panels wherein said support rod has a cross-sectional size able to pass through said center hole and wherein a longitudinal axis of said support rod is oriented substantially parallel to said bottom panel such that said weights may be supported on said support rod; and a tab extension coupled to each of said side panels and a slot in each of said bottom panels, said tabs engaging with said slots to retain said material when it is folded.

* * * * *

UNITED STATES PATENT AND TRADEMARK OFFICE

CERTIFICATE OF CORRECTION

PATENT NO. : 4,993,770

DATED : 02/19/91

INVENTOR(S) : Groves

It is certified that error in the above-identified patent and that said Letters Patent is hereby corrected as shown below:

| | | |
|---|---|---|
| col. 03, line 42 | delete "2b" | insert --12b-- |

Signed and Sealed this

Fifteenth Day of December, 1992

*Attest:*

DOUGLAS B. COMER

*Attesting Officer*

*Acting Commissioner of Patents and Trademarks*